US009978216B2

(12) United States Patent
Bramble

(10) Patent No.: US 9,978,216 B2
(45) Date of Patent: May 22, 2018

(54) METHOD OF GAMING, A GAMING SYSTEM AND A GAME CONTROLLER

(71) Applicant: Aristocrat Technologies Australia Pty Limited, North Ryde, NSW (AU)

(72) Inventor: Paul Francis Jason Bramble, Leumeah (AU)

(73) Assignee: Aristocrat Technologies Australia Ply Limited (AU)

( * ) Notice: Subject to any disclaimer, the term of this patent is extended or adjusted under 35 U.S.C. 154(b) by 4 days.

(21) Appl. No.: 15/419,520

(22) Filed: Jan. 30, 2017

(65) Prior Publication Data

US 2017/0186274 A1 Jun. 29, 2017

Related U.S. Application Data

(63) Continuation of application No. 13/656,132, filed on Oct. 19, 2012, now Pat. No. 9,555,321, which is a (Continued)

(30) Foreign Application Priority Data

Mar. 28, 2008 (AU) ..... 2008901496

(51) Int. Cl.
*G07F 17/34* (2006.01)
*G07F 17/32* (2006.01)
*A63F 9/24* (2006.01)

(52) U.S. Cl.
CPC ..... *G07F 17/3267* (2013.01); *A63F 9/24* (2013.01); *G07F 17/3255* (2013.01); *G07F 17/3258* (2013.01); *G07F 17/34* (2013.01)

(58) Field of Classification Search
CPC ... G07F 17/34; G07F 17/3267; G07F 17/3258
(Continued)

(56) References Cited

U.S. PATENT DOCUMENTS 5,280,909 A * 1/1994 Tracy ..... G07F 17/32 463/27
5,803,451 A 9/1998 Kelly et al.
(Continued)

FOREIGN PATENT DOCUMENTS

AU 2005232538 10/2005
AU 2006252627 12/2006
(Continued)

*Primary Examiner* — Omkar Deodhar
*Assistant Examiner* — Shauna-Kay Hall
(74) *Attorney, Agent, or Firm* — McAndrews, Held & Malloy, Ltd.

(57) ABSTRACT

A method of gaming comprising conducting one or more paid game rounds initiated in response to the payment of a wager by a player and a series of one or more free game rounds initiated in response to a free game series trigger event, the method comprising: in each paid game round, selecting a set of paid game round symbols for display to the player, determining a paid game round outcome based on the selected symbols, and incrementing a jackpot by a paid game jackpot increment; in each free game round, selecting a set of free game round symbols for display to the player, determining a free game round outcome based on the selected symbols, and incrementing the jackpot by a free game jackpot increment; and awarding the jackpot on the occurrence of a jackpot award event.

10 Claims, 6 Drawing Sheets

Related U.S. Application Data continuation of application No. 12/412,881, filed on Mar. 27, 2009, now Pat. No. 8,317,605.

(58) Field of Classification Search
USPC ..... 463/25–27
See application file for complete search history.

(56) References Cited

U.S. PATENT DOCUMENTS

| | | | | |
|---|---|---|---|---|
| 6,039,648 | A | 3/2000 | Guinn et al. | |
| 6,045,130 | A | 4/2000 | Jones et al. | |
| 6,070,878 | A | 6/2000 | Jones et al. | |
| 6,234,895 | B1 | 5/2001 | Jones et al. | |
| 6,312,330 | B1 | 11/2001 | Jones et al. | |
| 6,398,218 | B1 | 6/2002 | Vancura | |
| 6,416,409 | B1 * | 7/2002 | Jordan | G07F 17/32 463/27 |
| 6,475,088 | B1 | 11/2002 | Jones et al. | |
| 7,029,395 | B1 | 4/2006 | Baerlocher | |
| 7,033,272 | B1 | 4/2006 | Mason | |
| 7,056,215 | B1 | 6/2006 | Olive | |
| 7,892,088 | B2 | 2/2011 | Brandstetter et al. | |
| 2001/0024969 | A1 | 9/2001 | Jones et al. | |
| 2002/0077168 | A1 | 6/2002 | Jones et al. | |
| 2002/0180152 | A1 | 12/2002 | Gauselmann | |
| 2003/0027630 | A1 | 2/2003 | Kelly et al. | |
| 2003/0146574 | A1 | 8/2003 | Duhamel | |
| 2004/0009808 | A1 | 1/2004 | Gauselmann | |
| 2004/0087368 | A1 | 5/2004 | Gauselmann | |
| 2004/0142740 | A1 | 7/2004 | Damico et al. | |
| 2005/0026691 | A1 | 2/2005 | Mathis | |
| 2005/0054429 | A1 * | 3/2005 | Baerlocher | G07F 17/3244 463/25 |
| 2006/0073897 | A1 | 4/2006 | Englman et al. | |
| 2007/0054728 | A1 | 3/2007 | Hood | |
| 2007/0060241 | A1 | 3/2007 | Low et al. | |
| 2007/0060271 | A1 | 3/2007 | Cregan et al. | |
| 2007/0063443 | A1 | 3/2007 | Moshal | |
| 2007/0117607 | A1 | 5/2007 | Olive | |
| 2007/0149268 | A1 | 6/2007 | Gauselmann | |
| 2007/0155474 | A1 | 7/2007 | Gauselmann | |
| 2007/0167206 | A1 | 7/2007 | Kirkutis | |
| 2007/0213114 | A1 | 9/2007 | Caspers et al. | |
| 2007/0218972 | A1 | 9/2007 | Gerson et al. | |
| 2007/0259711 | A1 | 11/2007 | Thomas | |
| 2007/0259714 | A1 | 11/2007 | Block et al. | |
| 2007/0273097 | A1 | 11/2007 | Kirkutis | |
| 2008/0153587 | A1 | 6/2008 | Yoshimura | |
| 2008/0311973 | A1 | 12/2008 | Jaffe | |
| 2009/0131159 | A1 | 5/2009 | Englman et al. | |
| 2009/0247277 | A1 | 10/2009 | Caspers et al. | |
| 2010/0016060 | A1 * | 1/2010 | Jaffe | G07F 17/3258 463/20 |
| 2010/0069146 | A1 | 3/2010 | Kato | |
| 2011/0130191 | A1 | 6/2011 | Englman et al. | |
| 2011/0130192 | A1 | 6/2011 | Englman et al. | |

FOREIGN PATENT DOCUMENTS

| | | |
|---|---|---|
| AU | 2006252113 | 10/2007 |
| CA | 2118434 | 4/1996 |
| CA | 2399393 | 8/2001 |
| CA | 2595133 | 1/2008 |
| DE | 3915655 | 11/1990 |
| DE | 10237965 | 7/2003 |
| JP | 2006239465 | 9/2006 |
| JP | 2007105176 | 4/2007 |
| JP | 2007105177 | 4/2007 |
| JP | 2007244630 | 9/2007 |
| NZ | 518209 | 9/2004 |
| NZ | 544852 | 6/2007 |
| TW | 581705 | 4/2004 |
| WO | 9611730 | 4/1996 |
| WO | 03067534 | 8/2003 |
| WO | 2005043473 | 5/2005 |
| WO | 2005099425 | 10/2005 |
| WO | 2006130611 | 12/2006 |
| WO | 2007094250 | 8/2007 |
| WO | 2007112488 | 10/2007 |
| WO | 2007128033 | 11/2007 |

* cited by examiner

METHOD OF GAMING, A GAMING SYSTEM AND A GAME CONTROLLER

RELATED APPLICATIONS

This application is a continuation of U.S. patent application Ser. No. 13/656,132, having a filing date of Oct. 19, 2012, expected to issue as U.S. Pat. No. 9,555,321 on Jan. 31, 2017, which is a continuation of U.S. patent application Ser. No. 12/412,881, having a filing date of Mar. 27, 2009, now U.S. Pat. No. 8,317,605 issued Nov. 27, 2012, which claims priority to Australia Provisional Patent Application No. 2008901496 having a filing date of Mar. 28, 2008, the contents of each of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming systems are known comprising a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine with selected symbols displayed in virtual reels on a video display.

Commonly progressive awards known as jackpots can be provided which increment as a wager is made by the player for each game round. Each increment is typically proportional to the wager, and therefore increments only occur during games when a wager is placed. Also known are free games which are awarded free of charge to the player on a trigger event. Since jackpots are typically proportional to the wager, they are not incremented during the free games and this can give the impression to the player that the free game is not genuinely a full game, lacking the benefit of the jackpot increment.

There is a need for alternative or enhanced gaming systems and methods to add to player enjoyment during free or feature games.

BRIEF SUMMARY OF THE INVENTION

According to a first aspect of the invention there is provided a method of gaming having a series of one or more paid game rounds initiated in response to the payment of a wager by a player and a series of one or more free game rounds initiated in response to a free game series trigger event, comprising:

in each paid game round, selecting a set of paid game round symbols for display to the player, determining a paid game round outcome based on the selected symbols, and incrementing a jackpot by a paid game jackpot increment;

in each free game round, selecting a set of free game round symbols for display to the player, determining a free game round outcome based on the selected symbols, and incrementing the jackpot with a free game jackpot increment; and awarding the jackpot on the occurrence of a jackpot award event.

In one embodiment the paid game jackpot increment, the free game jackpot increment, an expected number of free game rounds in each series of free game rounds and an average number of game rounds between the free game series trigger events are together chosen so as to provide an expected average jackpot increment per unit wager equal to a desired amount.

In one embodiment the paid game jackpot increment and the free game jackpot increment are equal.

In one embodiment the free game series trigger event cannot occur during the free game rounds, whereby the jackpot increment i is given by the formula $i=w*d/(1+n/t)$, where w is the wager in the paid games, d is the desired amount of the average jackpot increment per unit wager, n is the expected number of free game rounds in each series of free game rounds, and t is the average number of game rounds between the free game trigger events.

In another embodiment the free game series trigger event can occur during the free game rounds, whereby the jackpot increment i is given by the formula $i=w*d*(1-n/t)$, where $n<t$ and w is the wager in the paid games, d is the desired average jackpot increment, n is the expected number of free game rounds in each series of free game rounds, and t is the average number of game rounds between the free game trigger events.

In one embodiment the symbols selected in the paid game rounds are displayed to the player in a set of display positions corresponding to respective ones of a plurality of spinning reels.

In one embodiment the symbols selected in the free game rounds are displayed to the player in a set of display positions corresponding to respective ones of a plurality of spinning reels.

According to a second aspect of the invention there is provided a gaming system for implementing a series of one or more paid game rounds initiated in response to the payment of a wager by a player and a series of one or more free game rounds initiated in response to a free game trigger event, comprising:

a display for symbols to be displayed to the player;

a paid game round controller for implementing in each paid game round, having a paid game round symbol selector for selecting a set of paid game round symbols for display to the player, a paid game round outcome determiner for determining a paid game round outcome based on the selected symbols, and a paid game round jackpot incrementer for incrementing a jackpot by a paid game jackpot increment;

a free game series trigger controller for triggering each of the series of free game rounds;

a free game round controller for implementing each free game round, having a paid game round symbol selector for selecting a set of free game round symbols for display to the player, a free game round outcome determiner for determining a free game round outcome based on the selected symbols, and a free game round jackpot incrementer for incrementing the jackpot with a free game jackpot increment; and a jackpot awarder for awarding the jackpot on the occurrence of a jackpot award event.

In one embodiment the gaming system is adapted so that the paid game jackpot increment, the free game jackpot increment, an expected number of free game rounds in each series of free game rounds and an average number of game rounds between the free game series trigger events are together chosen so as to provide an expected average jackpot increment per unit wager equal to a desired amount.

In one embodiment the jackpot incrementers are adapted so that the paid game jackpot increment and the free game jackpot increment are equal.

In one embodiment the free game series trigger controller is adapted so that the free game series trigger events cannot occur during the free game rounds, and the jackpot incrementers are adapted so that the jackpot increment i is given by the formula $i=w*d/(1+n/t)$, where w is the wager in the paid games, d is the desired amount of the average jackpot increment per unit wager, n is the expected number of free game rounds in each series of free game rounds, and t is the average number of game rounds between the free game series trigger events.

In another embodiment the free game series trigger controller is adapted so that the free game series trigger events can be awarded during the free game rounds, whereby the jackpot increment i is given by the formula $i=w*d*(1-n/t)$, where $n<t$ and w is the wager in the paid games, d is the desired average jackpot increment, n is the expected number of free game rounds in each series of free game rounds, and t is the average number of game rounds between the free game series trigger events.

In one embodiment the symbols selected in the paid game rounds are displayed to the player in a set of display positions corresponding to respective ones of a plurality of spinning reels.

In one embodiment the symbols selected in the free game rounds are displayed to the player in a set of display positions corresponding to respective ones of a plurality of spinning reels.

In some embodiments at least one of the paid game round controller, the free game series trigger controller, the free game round controller, and the jackpot award controller is implemented at least in part, by a processor executing code stored in a memory.

In one embodiment the display forms part of a player interface which further comprises a game play mechanism operable to place a bet.

According to a third aspect of the invention there is provided a game controller for implementing a series of one or more paid game rounds initiated in response to the payment of a wager by a player and a series of one or more free game rounds initiated in response to a free game trigger event, comprising:

a paid game round controller for implementing in each paid game round, having a paid game round symbol selector for selecting a set of paid game round symbols for display to the player on a display, a paid game round outcome determiner for determining a paid game round outcome based on the selected symbols, and a paid game round jackpot incrementer for incrementing a jackpot by a paid game jackpot increment;

a free game series trigger controller for triggering each of the series of free game rounds;

a free game round controller for implementing each free game round, having a paid game round symbol selector for selecting a set of free game round symbols for display to the player, a free game round outcome determiner for determining a free game round outcome based on the selected symbols, and a free game round jackpot incrementer for incrementing the jackpot with a free game jackpot increment; and a jackpot awarder for awarding the jackpot on the occurrence of a jackpot award event.

In one embodiment the game controller is adapted so that the paid game jackpot increment, the free game jackpot increment, an expected number of free game rounds in each series of free game rounds and an average number of game rounds between the free game trigger events are together chosen so as to provide an expected average jackpot increment per unit wager equal to a desired amount.

In one embodiment the jackpot incrementers are adapted so that the paid game jackpot increment and the free game jackpot increment are equal.

In one embodiment the free game series trigger controller is adapted so that the free game series trigger events cannot be awarded during the free game rounds, and the jackpot incrementers are adapted so that the jackpot increment i is given by the formula $i=w*d/(1+n/t)$, where $n<t$ and w is the wager in the paid games, d is the desired amount of the average jackpot increment per unit wager, n is the expected number of free game rounds in each series of free game rounds, and t is the average number of game rounds between the free game series trigger events.

In another embodiment the free game series trigger controller is adapted so that the free game series trigger events can be awarded during the free game rounds, whereby the jackpot increment i is given by the formula $i=w*d*(1-n/t)$, where $n<t$ and w is the wager in the paid games, d is the desired average jackpot increment, n is the expected number of free game rounds in each series of free game rounds, and t is the average number of game rounds between the free game series trigger events.

In one embodiment the symbols selected in the paid game rounds are displayed to the player in a set of display positions corresponding to respective ones of a plurality of spinning reels.

In one embodiment the symbols selected in the free game rounds are displayed to the player in a set of display positions corresponding to respective ones of a plurality of spinning reels.

In some embodiments at least one of the paid game round controller, the free game series trigger controller, the free game round controller, and the jackpot award controller is implemented at least in part, by a processor executing code stored in a memory.

According to a fourth aspect of the invention there is provided computer program code when executed by a computer causes the computer to implement any of the embodiments of the method of gaming of the first aspect of the invention.

According to a fifth aspect of the invention there is provided a computer readable medium comprising the program code of the fourth aspect of the invention.

According to a sixth aspect of the invention there is provided a data signal comprising the computer program code of the fourth aspect of the invention.

DETAILED DESCRIPTION OF THE INVENTION

Figure 1:
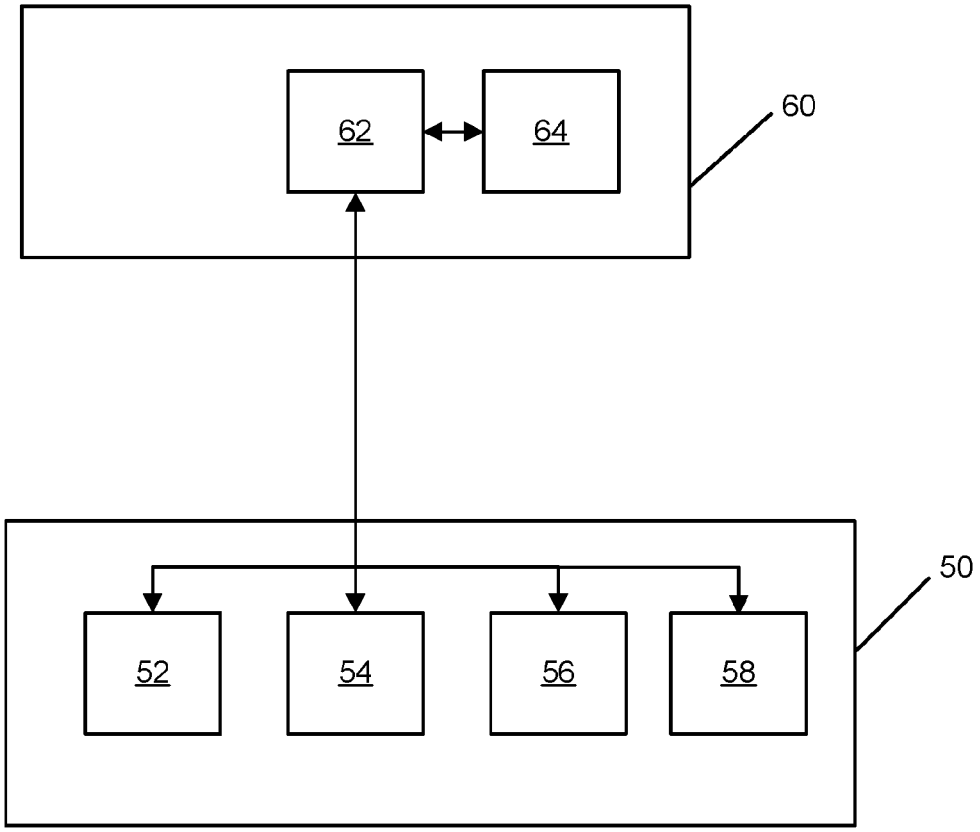
FIG. 1 is a block diagram of the core components of a gaming system.

Referring to the drawings, there is shown a gaming system having a game controller arranged to implement a game wherein a progressive jackpot is incremented during each free game of a free game series when a free game series is awarded.

The gaming system may take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 comprising one or more input devices that enable a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
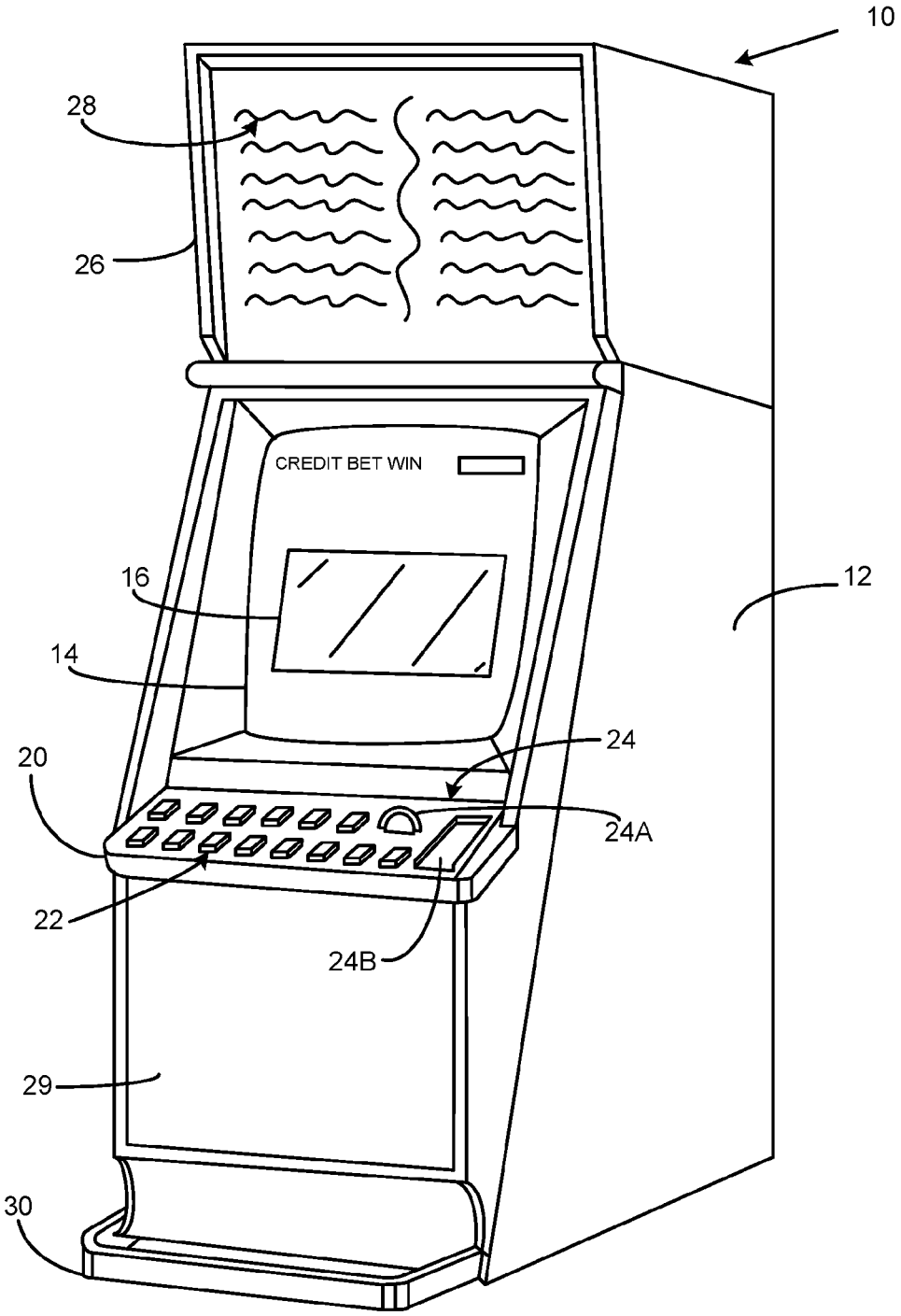
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 providing input devices for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
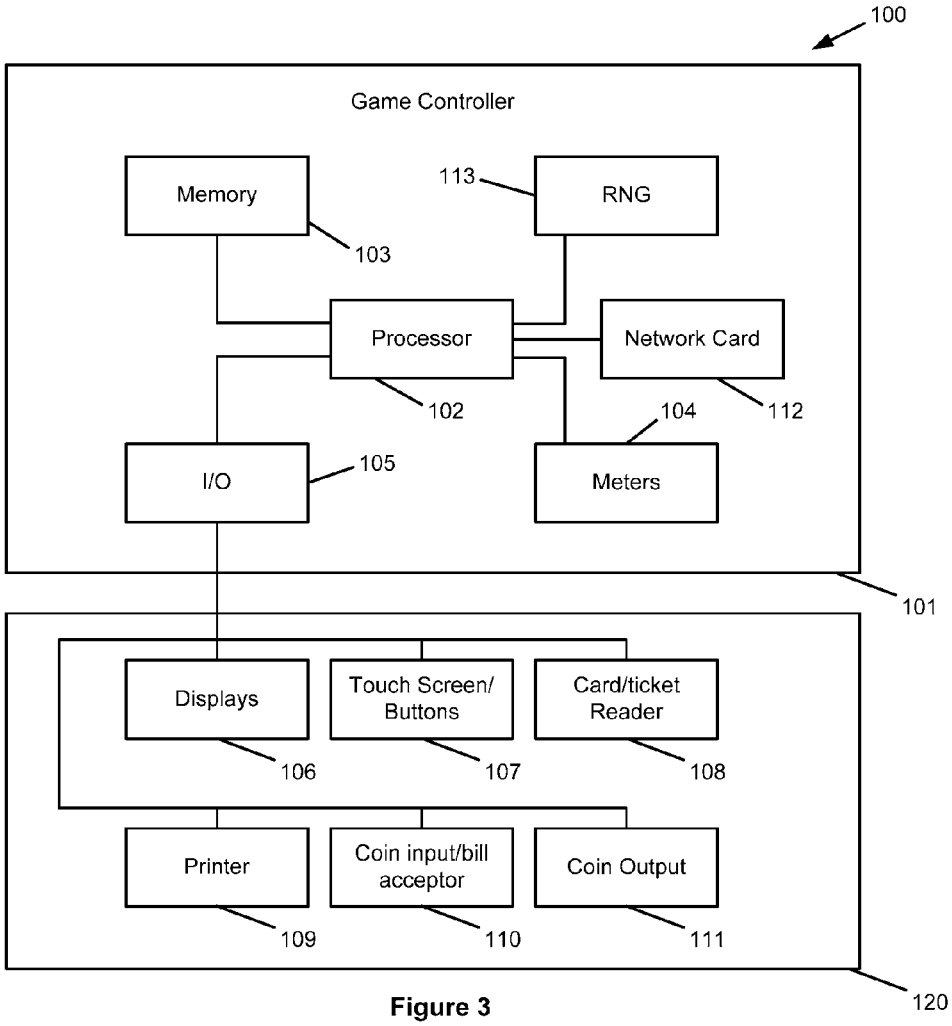
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 and comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while input devices in the form of a touch screen or buttons are commonly used in gaming machines, other input devices could be used to form a game play mechanism. For example, in some gaming machines a handle is uses to initiate a play of the game.

In addition, the gaming machine 100 may include a communications interface, for example a network card 112. The network card may, for example, send status information, accounting information or other information to a central controller, server or database and receive data or commands from the central controller, server or database.

Figure 4:
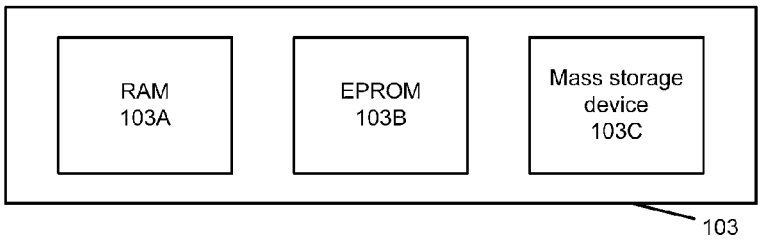
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
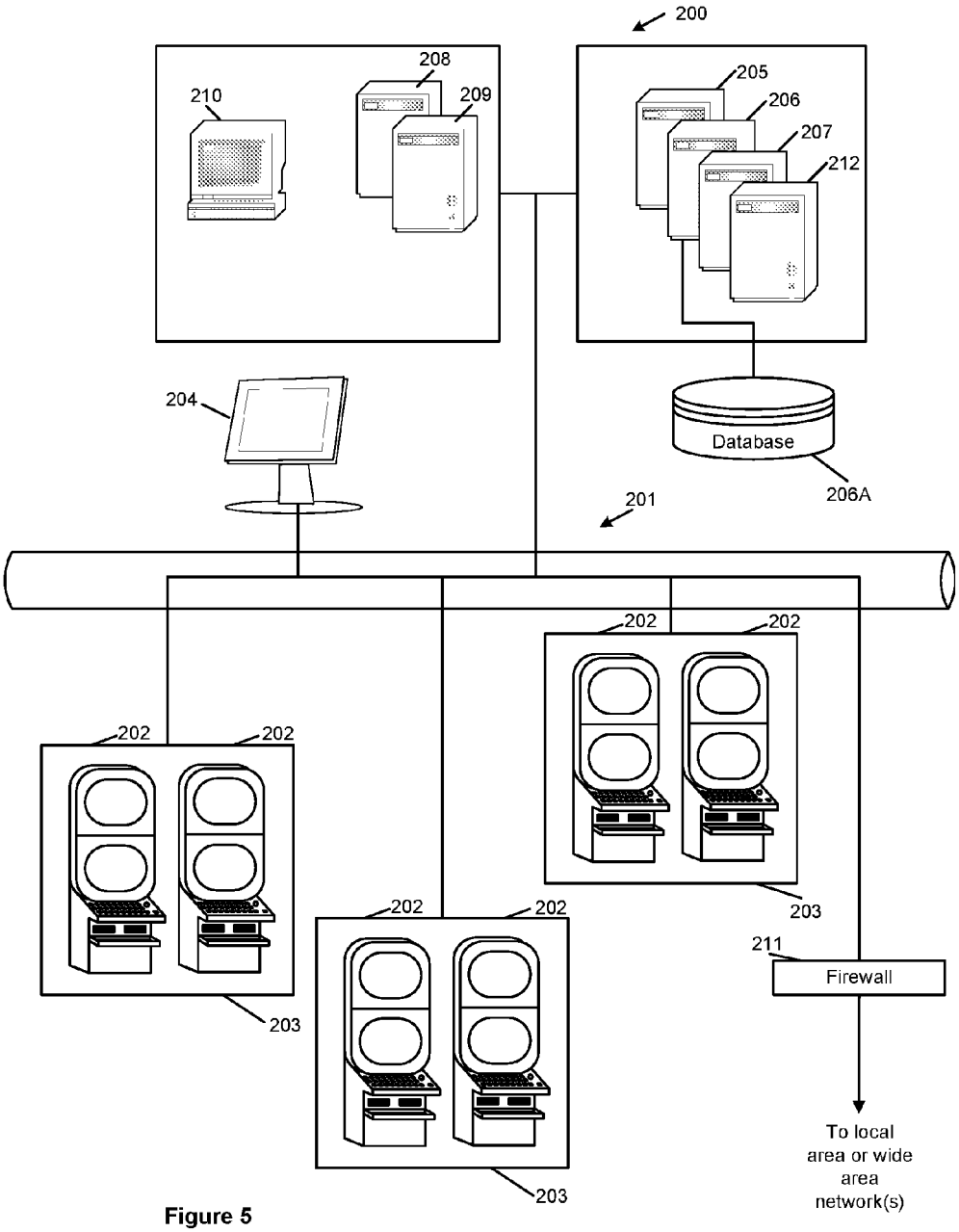
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

This invention can apply to all forms of games such as card games, keno, bingo, pin and ball games or any other game which has an incrementing jackpot.

Embodiments of the invention relate to gaming systems for implementing games that involve a display of spinning reels as part of the display of the outcome of the game.

The game controllers of such gaming systems have a stop determining function that determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" corresponding to a "single win line" game. When a reel stops, the symbols will be in one of a plurality of possible symbol positions for that reel relative to the stop position.

Exemplary embodiments of the present invention relate to gaming systems that allow a player to select, in non-feature games, how many win lines of a plurality of win lines they will play in each game—i.e. a minimum of one win line up to the maximum number of win lines allowed by the game. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line.

Figure 6:
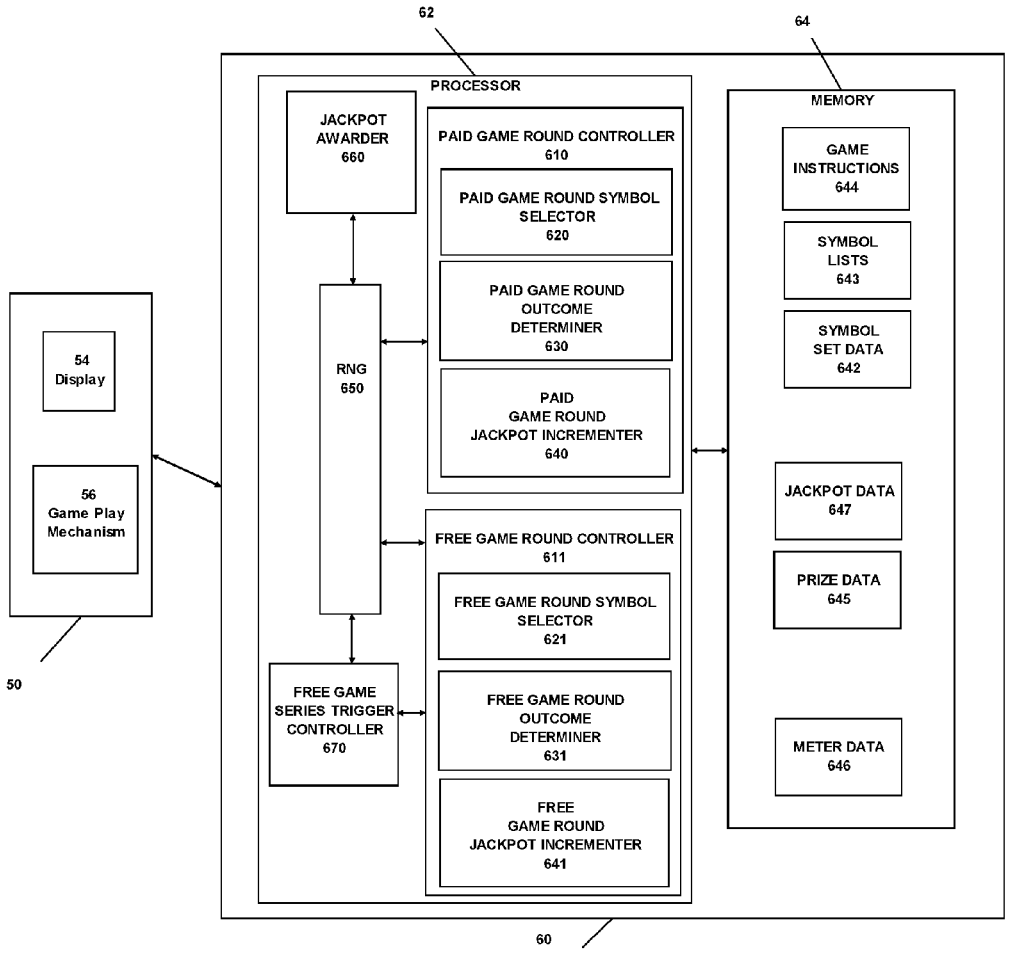
FIG. 6 is a further block diagram of the gaming system.

The game controller of one embodiment is shown in more detail in FIG. 6. The game controller 60 incorporates a processor 62 which implements in software paid game round controller 610 and free game round controller 611, operably interconnected with random number generator 650, free game series trigger controller 670 and jackpot awarder 660. Paid game round controller 610 further comprises paid game round symbol selector 620, paid game round outcome determiner 630 and paid game round jackpot incrementer 640. Similarly, free game round controller 611 further comprises free game round symbol selector 621, free game round outcome determiner 631 and free game round jackpot incrementer 641. Connected to the processor 62 is a memory 64 incorporating game instructions 644, symbol lists 643, symbol set data 642, prize data 645, meter data 646 and jackpot data 647.

Persons skilled in the art will appreciate that one or more of these components could be provided in other ways, for example by a dedicated circuit.

In an example of a game to which the invention is applied, in a paid game round controlled by paid game round controller 610, paid game round symbol selector 620 selects symbols for display from symbol lists 643, updates symbol set data 642 with the selected set of symbols and displays the set of symbols in their assigned display positions on the display 54. Paid game round outcome determiner 630 determines a paid game round outcome based on the win lines defining one symbol on each reel, using prize data 645 and then updates meter data 646. Paid game round jackpot incrementer 640 then increments the jackpot in jackpot data 647 by the paid game round jackpot increment. In a free game round, part of a series of one or more free game rounds triggered under the control of free game series trigger controller 670 by a random free game trigger event, free game round symbol selector 621 selects symbols for display from symbol lists 643, updates symbol set data 642 with the selected set of symbols and displays the set of symbols in their assigned display positions on the display 54. Free game round outcome determiner 631 determines a free game round outcome based on the win lines defining one symbol on each reel, using prize data 645 and then updates meter data 646. Free game round jackpot incrementer 641 then increments the jackpot in jackpot data 647 by the free game round jackpot increment. After the game round, either free or paid, jackpot awarder 660 determines whether to award the jackpot or allow it to increment further in the next game. Thus according to the invention both the free game rounds and the paid game rounds cause the jackpot to increment.

Figure 7:
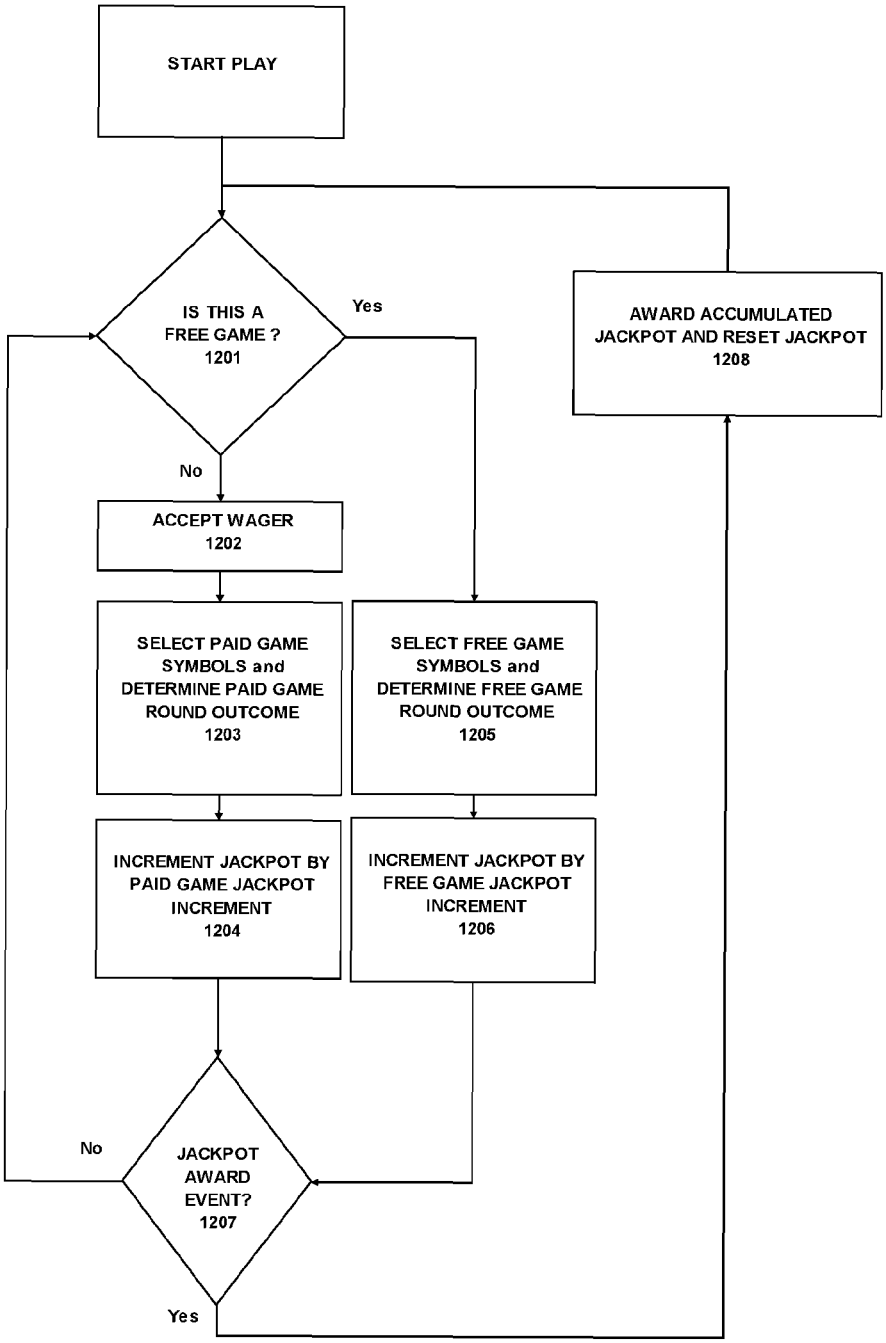
FIG. 7 shows a flow diagram for the method of an embodiment of the invention.

Now referring to FIG. 7, a flow diagram for an embodiment of the invention is shown. At the beginning of each game round, game controller 60 in step 1201 determines whether the game round is to be free or paid and passes control to either the free game round controller 611 or paid game round controller 610 respectively. A free game is either part of a new series as specified by free game series trigger controller 670 or one of an unfinished series of free game rounds previously started by free game series trigger controller 670. A paid game begins by the acceptance of a wager from the player in step 1202. Typically the acceptance of the wager will be an automatic step consisting of the decrement by a predetermined wager amount of a credit balance previously paid by the player. In step 1203 paid game round symbols are selected and a paid game round outcome is determined. Then in step 1204 the jackpot in jackpot data 647 is incremented by the paid game round jackpot increment. A free game round skips the wager step and in step 1205, free game round symbols are selected and a free game round outcome is determined. In simple embodiments the free and paid game round symbols are selected from the same set of symbols and the outcomes are determined from the same set of rules. In accordance with the invention, in step 1206 the jackpot in jackpot data 647 is incremented by a free game round jackpot increment. In simple embodiments, the paid and free game round jackpot increments are an equal fixed amount. In step 1207, jackpot awarder 660 determines whether the jackpot should be awarded. If so, the jackpot is awarded, updating meter data 646 and jackpot data 647 is reset to zero. Control then returns to step 1201 for the next game round.

Example 1

A specific example of a game according to the invention is now described, with particular reference to a computation method for determining the jackpot increment i in order not to modify expected total winnings per wager. In this example where the free game and paid game round jackpot increments are the same.

There is a desired amount of the average jackpot increment per wager d which is simply set as the increment after each wager in the prior art systems where the free game jackpot increment is zero. In order to maintain the average jackpot increment per wager at d when the paid game and free game jackpot increments are both the same, the jackpot increment must be reduced by a factor equal to the expected average total number of games as a ratio of the total number of wager games.

In this example, free game trigger events can only occur in paid game rounds and cannot be awarded inside a free game round. In this circumstance, the ratio of total games to wager games is $(1+n/t)$ where n is the average number of free game rounds in each series of free game rounds, and t is the average number of game rounds between free game series trigger events. The actual number of free game rounds and the actual number of game rounds between free game series trigger events in general belongs to a probability distribution with mean n and t respectively to maintain player anticipation as to the number which might be awarded after each free game series trigger event and when they might occur.

Consequently d is maintained as the average amount of the jackpot increment per unit wager if the jackpot increment i is chosen so that $i=w*d/(1+n/t)$, where w is the wager in each of the paid games.

Consider for the sake of clarity some particular numbers applied to this example. The wager is \$2 and the desired average increment per unit wager is d=0.01. The average number of free games awarded in a free game series is n=10, and the average number of game rounds between free game trigger events is t=100. Using the formula, i=\$2*0.01/(1+0.1)=\$0.018181818 . . . =1.8181818 . . . cents.

Example 2

In this example, the case of a free game trigger event which can occur with equal probability in the free games and the paid games is considered. In this case, the ratio of total games to paid games is slightly larger than in example 1 and is a infinite geometric series $(1+n/t+(n/t)^2+(n/t)^3+\ldots)$ converging, as long as $n<t$, to $1/(1-n/t)$. The formula for i thus takes the simple form $i=w*d*(1-n/t)$.

Consider some particular numbers applied to this example. The wager is $2 and the desired average increment per unit wager is d=0.01. The average number of free games awarded in a free game series is n=10, and the average number of game rounds between free game series trigger events is t=100. Using the formula, i=$2*0.01*(1−0.1)=$0.018=1.8 cents.

Example 3

In this example, free game series cannot be triggered during free games, as in example 1, but the increments to be applied to the free games and the paid games are not equal. To make the free games have even more value the free game jackpot increment can be larger, or to make the free games less valuable the free game jackpot increment can be smaller than the paid game jackpot increment. Call the ratio of free game jackpot increment to paid game jackpot increment r, so that the paid game jackpot increment is i and the free game jackpot increment is i*r. In this case, to achieve d we need i=w*d/(1+r*n/t).

If the same numbers as in example 1 are used and r=2, the paid game increment i is $2*0.01/(1+2*0.1)=$0.0166 66 . . . =1.666 . . . cents.

Example 4

In this example, free game series can be triggered during free games, as in example 2, but as in example 3 the increments to be applied to the free games and the paid games are not equal. As in example 3 call the ratio of free game jackpot increment to paid game jackpot increment r, so that the paid game jackpot increment is i and the free game jackpot increment is i*r. In this case, to achieve d we need $i=w*d/(1+r*((n/t)+(n/t)^2+(n/t)^3+(n/t)^4+ \ldots ))$, which converges when n<t to i=w*d*(1−n/t)/(1−n/t(1−r))

If the same numbers as in example 2 are used and r=2, the paid game increment i is $2*0.01*(1−0.1)/(1−0.1*(1−2))=$2*0.01*0.9/1.1=1.6363636 . . . cents.

Persons skilled in the art will recognize that the invention resides in the additional possibilities that are presented by releasing the attachment of the jackpot increment to the wager, and more complex games than those exemplified here are within the scope of the invention. Also, the main game can be any game involving symbols and awards, not just spinning reels. Further, when the paid game and free games have sub-processes which are the same, the paid and free game controllers can have elements which are implemented in common, for example symbol selection can be performed be a common symbol selection function of the game controller.

Persons skilled in the art will appreciate that in some embodiments that the jackpot may be accrued and awarded in a number of different ways. For example, the gaming system may incorporate a jackpot controller 205 as shown in FIG. 5 to accrue jackpot increments from a plurality of game controllers. In such embodiments, it will be appreciated that the jackpot incrementers of the game controller increment the jackpot in the sense that they cause the jackpot controller to increment a jackpot pool.

In such embodiments, the jackpot award event can be any of those known in the art, for example, a symbol combination occurring at the game controller of a gaming machine, a random calculation occurring at the gaming machine or the jackpot pool reaching a designated value as determined by the jackpot controller (i.e. such that the jackpot awarder is provided by the jackpot controller). It will also be appreciated that there may be a plural of different jackpot pools which may be associated with different jackpot award events.

Persons skilled in the art will appreciate that other aspects of existing progressive jackpots may also be included. For example, in many implementations of progressive jackpots, the machine or jackpot controller has an accounting feature which is a "pool" in which a percentage of all turnover is "stored". (commonly referred to as a hidden meter). Start up amounts for jackpots are usually funded from these pools so that the jackpot starts at a non-zero amount after it has been won.

Persons skilled in the art will appreciate that the trigger event for the free game series may be any of the trigger events known in the art, for example a symbol combination, a turnover, a random determination, an external event etc.

Persons skilled in the art will appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

Persons skilled in the art will also appreciate that many variations may be made to the invention without departing from the scope of the invention. For example, features described above may be combined to form further embodiments.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A method of gaming for use with a gaming machine configured to play of a plurality of paid game rounds and play of at least one free game round triggered by a trigger event, the gaming machine having a credit input mechanism configured to receive a physical item representing a monetary value for establishing a credit balance, the credit balance being increasable and decreasable based at least on wagering activity, a display configured to display at least one paid game round and at least one free game round, a memory containing a jackpot amount, a payout mechanism, and a game controller, the method comprising:

establishing a credit balance via said credit input mechanism receiving the physical item;

causing via the game controller the display to display a plurality of paid game rounds in response to wagering activity;

causing via the game controller the display to display at least one free game round in response to a trigger event;

incrementing via the game controller the jackpot amount by a paid game round jackpot increment in response to play of at least one paid game round, the paid game round jackpot increment having a first determined amount;

incrementing via the game controller the jackpot amount by a free game round jackpot increment in response to play of the at least one free game round, the free game round jackpot increment having a second amount determined so as to provide an average jackpot increment per unit wager; and selecting the paid game jackpot increment, the free game jackpot increment, an expected number of free game rounds in each series of free game rounds and an average number of game rounds between the free game series trigger events so as to provide an expected average jackpot increment per unit wager equal to a desired amount; and providing via the payout mechanism payouts to a player.

2. A method of gaming as claimed in claim 1, wherein symbols selected in the paid game rounds are displayed to the player in a set of display positions corresponding to respective ones of a plurality of spinning reels.

3. A method of gaming as claimed in claim 1, wherein symbols selected in the free game rounds are displayed to the player in a set of display positions corresponding to respective ones of a plurality of spinning reels.

4. A method of gaming for use with a gaming machine configured to play of a plurality of paid game rounds and play of at least one free game round triggered by a trigger event, the gaming machine having a credit input mechanism configured to receive a physical item representing a monetary value for establishing a credit balance, the credit balance being increasable and decreasable based at least on wagering activity, a display configured to display at least one paid game round and at least one free game round, a memory containing a jackpot amount, a payout mechanism, and a game controller, the method comprising:

establishing a credit balance via said credit input mechanism receiving the physical item;

causing via the game controller the display to display a plurality of paid game rounds in response to wagering activity;

causing via the game controller the display to display at least one free game round in response to a trigger event;

incrementing via the game controller the jackpot amount by a paid game round jackpot increment in response to play of at least one paid game round, the paid game round jackpot increment having a first determined amount;

incrementing via the game controller the jackpot amount by a free game round jackpot increment in response to play of the at least one free game round, the free game round jackpot increment having a second amount determined so as to provide an average jackpot increment per unit wager; and establishing the paid game jackpot increment and the free game jackpot increment to be equal such that there is a single jackpot increment i; and preventing a free game series trigger event from occurring during the free game rounds and determining the single jackpot increment i using the formula $i=w*d/(1+n/t)$, where w is a wager in the paid games, d is a desired amount of an average jackpot increment per unit wager, n is an expected number of free game rounds in each series of free game rounds, and t is an average number of game rounds between free game trigger events; and providing via the payout mechanism payouts to a player.

5. A method of gaming for use with a gaming machine configured to play of a plurality of paid game rounds and play of at least one free game round triggered by a trigger event, the gaming machine having a credit input mechanism configured to receive a physical item representing a monetary value for establishing a credit balance, the credit balance being increasable and decreasable based at least on wagering activity, a display configured to display at least one paid game round and at least one free game round, a memory containing a jackpot amount, a payout mechanism, and a game controller, the method comprising:

establishing a credit balance via said credit input mechanism receiving the physical item;

causing via the game controller the display to display a plurality of paid game rounds in response to wagering activity;

causing via the game controller the display to display at least one free game round in response to a trigger event;

incrementing via the game controller the jackpot amount by a paid game round jackpot increment in response to play of at least one paid game round, the paid game round jackpot increment having a first determined amount;

incrementing via the game controller the jackpot amount by a free game round jackpot increment in response to play of the at least one free game round, the free game round jackpot increment having a second amount determined so as to provide an average jackpot increment per unit wager; and determining the paid game jackpot increment and the free game jackpot increment to be equal such that there is a single jackpot increment i; and wherein a free game series trigger event can occur during the free game rounds and determining the single jackpot increment i using the formula $i=w*d*(1-n/t)$, where $n<t$ and w is a wager in the paid games, d is a desired average jackpot increment, n is an expected number of free game rounds in each series of free game rounds, and t is an average number of game rounds between free game trigger events; and providing via the payout mechanism payouts to a player.

6. A gaming machine for play of a plurality of paid game rounds and play of at least one free game round triggered by a trigger event, comprising:

a credit input mechanism configured to receive a physical item representing a monetary value for establishing a credit balance, the credit balance being increasable and decreasable based at least on wagering activity;

a display configured to display at least one paid game round and at least one free game round;

a memory containing a jackpot amount;

a game controller configured (1) to play a plurality of paid game rounds in response to wagering activity; and (2) to play at least one free game round in response to a trigger event;

and wherein the game controller is further configured to increment the jackpot amount by a paid game round jackpot increment in response to play of at least one paid game round, and to increment the jackpot amount by a free game round jackpot increment in response to play of the at least one free game round, the paid game round jackpot increment having a first determined amount and the free game round jackpot increment having a second amount determined so as to provide an average jackpot increment per unit wager;

wherein the game controller is further configured to select the paid game jackpot increment, the free game jackpot increment, an expected number of free game rounds in each series of free game rounds and an average number of game rounds between the free game series trigger events so as to provide an expected average jackpot increment per unit wager equal to a desired amount; and a payout mechanism configured to provide payouts to a player.

7. A gaming machine as claimed in claim 6, wherein symbols selected in the paid game rounds are displayed to the player in a set of display positions corresponding to respective ones of a plurality of spinning reels.

8. A gaming machine as claimed in claim 6, wherein symbols selected in the free game rounds are displayed to the player in a set of display positions corresponding to respective ones of a plurality of spinning reels.

9. A gaming machine for play of a plurality of paid game rounds and play of at least one free game round triggered by a trigger event, comprising:

a credit input mechanism configured to receive a physical item representing a monetary value for establishing a credit balance, the credit balance being increasable and decreasable based at least on wagering activity;

a display configured to display at least one paid game round and at least one free game round;

a memory containing a jackpot amount;

a game controller configured (1) to play a plurality of paid game rounds in response to wagering activity; and (2) to play at least one free game round in response to a trigger event;

and wherein the game controller is further configured to increment the jackpot amount by a paid game round jackpot increment in response to play of at least one paid game round, and to increment the jackpot amount by a free game round jackpot increment in response to play of the at least one free game round, the paid game round jackpot increment having a first determined amount and the free game round jackpot increment having a second amount determined so as to provide an average jackpot increment per unit wager;

wherein the game controller is further configured to establish the paid game jackpot increment and the free game jackpot increment to be equal such that there is a single jackpot increment i; and wherein the game controller is further configured to prevent free game series trigger events from occurring during the free game rounds, and to determine the single jackpot increment i using the formula $i=w*d/(1+n/t)$, where w is a wager in the paid games, d is a desired amount of an average jackpot increment per unit wager, n is an expected number of free game rounds in each series of free game rounds, and t is an average number of game rounds between the free game series trigger events; and a payout mechanism configured to provide payouts to a player.

10. A gaming machine for play of a plurality of paid game rounds and play of at least one free game round triggered by a trigger event, comprising:

a credit input mechanism configured to receive a physical item representing a monetary value for establishing a credit balance, the credit balance being increasable and decreasable based at least on wagering activity;

a display configured to display at least one paid game round and at least one free game round;

a memory containing a jackpot amount;

a game controller configured (1) to play a plurality of paid game rounds in response to wagering activity; and (2) to play at least one free game round in response to a trigger event;

and wherein the game controller is further configured to increment the jackpot amount by a paid game round jackpot increment in response to play of at least one paid game round, and to increment the jackpot amount by a free game round jackpot increment in response to play of the at least one free game round, the paid game round jackpot increment having a first determined amount and the free game round jackpot increment having a second amount determined so as to provide an average jackpot increment per unit wager;

wherein the game controller is further configured to establish the paid game jackpot increment and the free game jackpot increment to be equal such that there is a single jackpot increment i; and wherein the game controller is further configured to allow free game series trigger events to be awarded during the free game rounds, to determine the single jackpot increment i using the formula $i=w*d*(1-n/t)$, where $n<t$ and w is a wager in the paid games, d is a desired average jackpot increment, n is an expected number of free game rounds in each series of free game rounds, and t is an average number of game rounds between the free game series trigger events; and a payout mechanism configured to provide payouts to a player.

* * * * *